US012747008B2

(12) United States Patent
Bergenwall

(10) Patent No.: US 12,747,008 B2
(45) Date of Patent: Sep. 29, 2026

(54) CONTROL OF FORCE FEEDBACK APPLICATION TO A MARINE VESSEL JOYSTICK

(71) Applicant: VOLVO PENTA CORPORATION, Gothenburg (SE)

(72) Inventor: Jonatan Bergenwall, Öjersjö (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 0 days.

(21) Appl. No.: 18/976,485

(22) Filed: Dec. 11, 2024

(65) Prior Publication Data

US 2025/0196981 A1 Jun. 19, 2025

(30) Foreign Application Priority Data

Dec. 13, 2023 (EP) ..... 23216226

(51) Int. Cl.
*B63B 79/00* (2020.01)
*B63B 79/40* (2020.01)
*B63H 25/02* (2006.01)

(52) U.S. Cl.
CPC ..... *B63B 79/40* (2020.01); *B63H 2025/026* (2013.01)

(58) Field of Classification Search
None
See application file for complete search history.

(56) References Cited

U.S. PATENT DOCUMENTS

| | | | | |
|---|---|---|---|---|
| 7,112,107 | B1 * | 9/2006 | Torgerud | B63H 21/213 440/2 |
| 9,927,520 | B1 * | 3/2018 | Ward | G01S 15/93 |
| 12,486,006 | B1 * | 12/2025 | Naik | B63B 43/18 |
| 2004/0027332 | A1 | 2/2004 | Cope et al. | |
| 2017/0253314 | A1 * | 9/2017 | Ward | B63H 25/42 |
| 2019/0361457 | A1 | 11/2019 | Johnson et al. | |
| 2020/0140052 | A1 * | 5/2020 | Derginer | B63H 25/42 |
| 2020/0202719 | A1 | 6/2020 | Derginer et al. | |
| 2020/0247518 | A1 * | 8/2020 | Dannenberg | B63H 25/42 |
| 2022/0126971 | A1 | 4/2022 | Matilainen et al. | |

(Continued)

OTHER PUBLICATIONS

Extended European Search Report in corresponding European Application No. 23216226.3 dated May 23, 2024 (9 pages).

(Continued)

*Primary Examiner* — Truc M Do
(74) *Attorney, Agent, or Firm* — Jeffri A. Kaminski; Venable LLP

(57) ABSTRACT

A marine maneuvering system for a marine vessel is provided. The marine maneuvering system comprises a marine vessel control unit configured to: obtain a requested movement of a joystick indicating a speed value and a direction value for an upcoming navigation of the marine vessel; obtain proximity signals from a proximity sensor in response to a target being sensed in at least portions of an environment surrounding the marine vessel at least towards a direction indicated by a direction value of the joystick; determine a distance between the marine vessel and the target based on the proximity signals; and control a force feedback device to apply a force feedback to the joystick based on the determined distance.

18 Claims, 5 Drawing Sheets

(56) References Cited

U.S. PATENT DOCUMENTS

2024/0025528 A1* 1/2024 Derginer ..... B63H 25/42

OTHER PUBLICATIONS

Eric Gustafsson and Jonathan Persson; "Joystick With Haptic Feedback for Vehicle Maneuvering"; Master's thesis in Automotive Engineering; Department of Mechanics and Maritime Sciences, Division of Vehicle Engineering and Autonomous Systems, Chalmers University of Technology, Goteborg, Sweden 2021; 71 pages.

* cited by examiner

CONTROL OF FORCE FEEDBACK APPLICATION TO A MARINE VESSEL JOYSTICK

TECHNICAL FIELD

The disclosure relates generally to navigation control in marine vessels. In particular aspects, the disclosure relates to control of force feedback application to a marine vessel joystick. The disclosure can be applied to marine vessels, such as leisure boats, ships, cruise ships, fishing vessels, yachts, ferries, among other vehicle types. Although the disclosure may be described with respect to a particular marine vessel, the disclosure is not restricted to any particular marine vessel.

BACKGROUND

For marine electronic vessel control (EVC) systems, currently existing input devices are typically mechanical devices without any ability to provide force feedback to a driver when used. Although some marine EVCs employ force feedback application to an input device of a marine vessel, the present inventor has identified further improvements concerning force feedback in marine vessel applications.

SUMMARY

According to a first aspect of the disclosure, there is provided a marine maneuvering system for a marine vessel. The marine maneuvering system comprises a proximity sensor configured to sense at least portions of an environment surrounding the marine vessel; an input device adapted to provide navigational commands to the marine vessel, wherein the input device comprises a movable joystick and a force feedback device being adapted to apply a force feedback to the joystick; and a marine vessel control unit operatively connected to the proximity sensor and the input device, the marine vessel control unit being configured to: obtain a requested movement of the joystick, the requested movement indicating a speed value and a direction value for an upcoming navigation of the marine vessel; obtain one or more proximity signals from the proximity sensor in response to at least one target being sensed in the environment at least towards a direction indicated by the direction value; determine a distance between the marine vessel and the at least one target based on the one or more proximity signals; and control the force feedback device to apply a force feedback to the joystick based on the determined distance. The first aspect of the disclosure may seek to provide situational awareness to an operator of a marine vessel. A technical benefit may include giving the operator of the marine vessel direct force feedback to the joystick being operated, which is related to the detection of at least one of these surrounding objects. The provided feedback may allow the operator to intuitively understand what risks that can be associated with the detected objects, and moreover automatically adapt the effect of a requested navigational command. This distance-based control of force feedback application may offer improved safety measures for both the marine vessel and its operator and for surrounding objects. Furthermore, the operator of the marine vessel may obtain a better understanding of the drivability of the marine vessel.

Optionally in some examples, including in at least one preferred example, the marine vessel control unit is further configured to control the force feedback device by: calculating a maximum allowed speed for the marine vessel based on the determined distance; translating the maximum allowed speed into a maximum allowed joystick movement; and limiting the requested movement of the joystick based on the maximum allowed joystick movement. A technical benefit may include causing movement of the requested joystick input to be limited according to allowable values, which provides the operator with intuitive understanding of a distance to a nearby object. This may offer safety improvements and a better understanding of the drivability of the marine vessel.

Optionally in some examples, including in at least one preferred example, the marine vessel control unit is further configured to limit the requested movement of the joystick by controlling the force feedback device to apply a force feedback value that counteracts a force of the requested movement. A technical benefit may include counteracting the force of the requested movement such that there may be a lesser risk of requesting a navigational command that is not allowed, thereby improving the operational safety of the marine vessel.

Optionally in some examples, including in at least one preferred example, the marine vessel control unit is further configured to control the force feedback device to gradually increase the applied force feedback when the distance between the marine vessel and the target is decreasing. A technical benefit may include a more intuitive force feedback application which may allow the operator to be increasingly (or decreasingly) warned depending on a current distance to sensed targets.

Optionally in some examples, including in at least one preferred example, the marine vessel control unit is further configured to control the force feedback device to gradually increase the applied force feedback when the speed value is increasing. A technical benefit may include a more intuitive force feedback application which may allow the operator to be increasingly (or decreasingly) warned depending on how high speed value is being requested.

Optionally in some examples, including in at least one preferred example, the applied force feedback is overridable by an applied external force to the joystick exceeding a value of the force feedback. A technical benefit may include allowing the operator to overtake control of the joystick, which can be useful for an improved drivability in situations of erroneous sensor readings or advanced driving situations where the operator cannot rely on the sensor readings.

Optionally in some examples, including in at least one preferred example, upon the proximity signals indicating a plurality of targets in the environment towards at least a direction indicated by the direction value, the marine vessel control unit being configured to: determine a distance between the marine vessel and each one of the plurality of targets; and control the force feedback device to apply a force feedback to the joystick based on each one of the determined distances. A technical benefit may include taking into account several targets in a combined control procedure, which may offer an improved feedback, intuitive understanding and drivability in situations where many targets are present, such as in a berthing area.

Optionally in some examples, including in at least one preferred example, the joystick being movable in three degrees of freedom, wherein the force feedback device comprises a respective force feedback unit for each degree of freedom of the joystick, wherein the marine vessel control unit is configured to control the application of the force feedback to the joystick through one or more of the force feedback units. A technical benefit may include providing more opportunities of notifying the operator not only that a target is sensed, but also where the target is sensed in the form of different portions of the joystick being associated with force feedback by the respective force feedback units. This may additionally improve the safety measures and/or understanding of the drivability of the marine vessel.

Optionally in some examples, including in at least one preferred example, the marine vessel control unit is further configured to control the force feedback device based on navigable water conditions where the marine vessel is traveling, the navigable water conditions including one or more of wind speed, wave height, current strength, and weather condition. A technical benefit may include an improved situational awareness of conditions where the marine vessel is traveling for a more adaptable and versatile control of force feedback application.

Optionally in some examples, including in at least one preferred example, the marine vessel control unit is further configured to: process the one or more proximity signals for determining at least one classification of the at least one target; and control the force feedback device to apply a force feedback to the joystick based on the determined at least one classification. A technical benefit may include an improved knowledge of target types for a more adaptable and versatile control of force feedback application.

Optionally in some examples, including in at least one preferred example, the marine vessel control unit is further configured to control the force feedback device to apply a fixed or variable force feedback value. A technical benefit may include a specific type of force feedback value to be applied depending on various circumstances, which may additionally improve the safety measures and/or understanding of the drivability of the marine vessel.

According to a second aspect of the disclosure, there is provided a marine vessel. The marine vessel comprises the marine maneuvering system according to the first aspect. The second aspect of the disclosure may seek to provide situational awareness to an operator of a marine vessel. A technical benefit may include giving the operator of the marine vessel direct force feedback to the joystick being operated, which is related to the detection of at least one of these surrounding objects. The provided feedback may allow the operator to intuitively understand what risks that can be associated with the detected objects, and moreover automatically adapt the effect of a requested navigational command. This distance-based control of force feedback application may offer improved safety measures for both the marine vessel and its operator and for surrounding objects. Furthermore, the operator of the marine vessel may obtain a better understanding of the drivability of the marine vessel.

According to a third aspect of the disclosure, there is provided a computer-implemented method for a marine vessel. The computer-implemented method comprises obtaining a requested movement of a joystick, the requested movement indicating a speed value and a direction value for an upcoming navigation of a marine vessel; obtaining one or more proximity signals from a proximity sensor in response to at least one target being sensed in the environment at least towards a direction indicated by the direction value; determining a distance between the marine vessel and the at least one target based on the one or more proximity signals; and controlling a force feedback device to apply a force feedback to the joystick based on the determined distance. The third aspect of the disclosure may seek to provide situational awareness to an operator of a marine vessel. A technical benefit may include giving the operator of the marine vessel direct force feedback to the joystick being operated, which is related to the detection of at least one of these surrounding objects. The provided feedback may allow the operator to intuitively understand what risks that can be associated with the detected objects, and moreover automatically adapt the effect of a requested navigational command. This distance-based control of force feedback application may offer improved safety measures for both the marine vessel and its operator and for surrounding objects. Furthermore, the operator of the marine vessel may obtain a better understanding of the drivability of the marine vessel.

According to a fourth aspect of the disclosure, there is provided a computer program product. The computer program product comprises program code for performing, when executed by processing circuitry, the method of the third aspect. The fourth aspect of the disclosure may seek to provide situational awareness to an operator of a marine vessel. A technical benefit may include giving the operator of the marine vessel direct force feedback to the joystick being operated, which is related to the detection of at least one of these surrounding objects. The provided feedback may allow the operator to intuitively understand what risks that can be associated with the detected objects, and moreover automatically adapt the effect of a requested navigational command. This distance-based control of force feedback application may offer improved safety measures for both the marine vessel and its operator and for surrounding objects. Furthermore, the operator of the marine vessel may obtain a better understanding of the drivability of the marine vessel.

According to a fifth aspect of the disclosure, there is provided a non-transitory computer-readable storage medium. The non-transitory computer-readable storage medium comprises instructions, which when executed by processing circuitry, cause the processing circuitry to perform the method of the third aspect. The fifth aspect of the disclosure may seek to provide situational awareness to an operator of a marine vessel. A technical benefit may include giving the operator of the marine vessel direct force feedback to the joystick being operated, which is related to the detection of at least one of these surrounding objects. The provided feedback may allow the operator to intuitively understand what risks that can be associated with the detected objects, and moreover automatically adapt the effect of a requested navigational command. This distance-based control of force feedback application may offer improved safety measures for both the marine vessel and its operator and for surrounding objects. Furthermore, the operator of the marine vessel may obtain a better understanding of the drivability of the marine vessel.

The disclosed aspects, examples (including any preferred examples), and/or accompanying claims may be suitably combined with each other as would be apparent to anyone of ordinary skill in the art. Additional features and advantages are disclosed in the following description, claims, and drawings, and in part will be readily apparent therefrom to those skilled in the art or recognized by practicing the disclosure as described herein.

There are also disclosed herein computer systems, control units, code modules, computer-implemented methods, computer readable media, and computer program products associated with the above discussed technical benefits.

BRIEF DESCRIPTION OF THE DRAWINGS

Examples are described in more detail below with reference to the appended drawings.

DETAILED DESCRIPTION

The detailed description set forth below provides information and examples of the disclosed technology with sufficient detail to enable those skilled in the art to practice the disclosure.

The present disclosure concerns controlling of force feedback application of a marine vessel joystick based on distance. In situations where a marine vessel is operating at bodies of water, e.g., the sea, there are typically a plurality of different situations that can occur relating to interactions with surrounding objects (also referred to as targets herein). The present disclosure suggests an approach that gives the operator of the marine vessel direct force feedback to the joystick being operated, which is related to the detection of at least one of these surrounding objects. The provided feedback may allow the operator to intuitively understand what risks that can be associated with the detected objects, and moreover automatically adapt the effect of a requested navigational command. This distance-based control of force feedback application may offer improved safety measures for both the marine vessel and its operator and for surrounding objects. Furthermore, the operator of the marine vessel may obtain better understanding of the drivability of the marine vessel.

Figure 1:
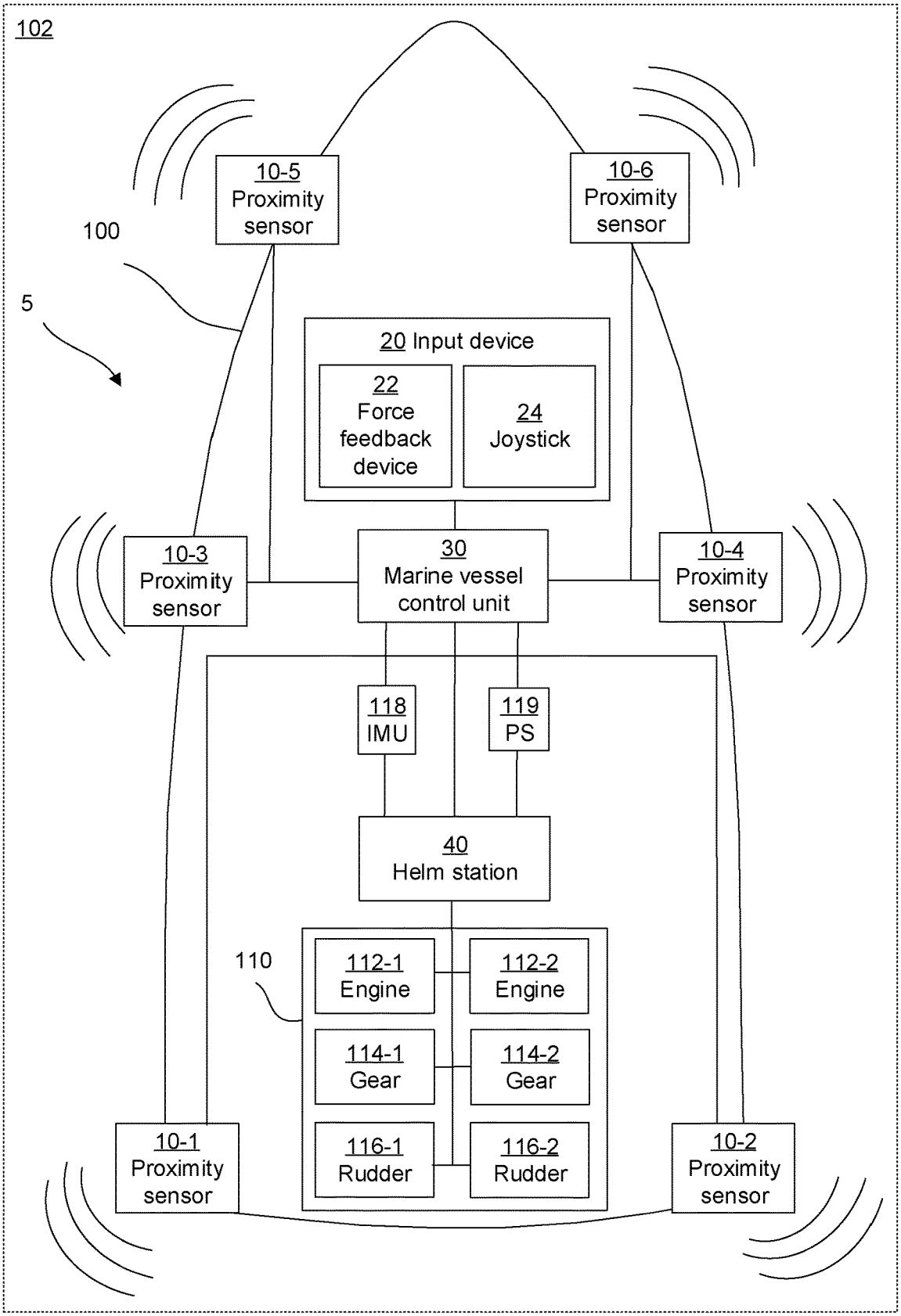
FIG. 1 is an exemplary system diagram of a marine vessel, according to an example.

FIG. 1 is schematic illustration of a marine vessel 100 in which some of the inventive concepts of the present disclosure may be applied. In non-limiting examples, the marine vessel 100 is a leisure boat, ship, cruise ship, fishing vessel, yacht, ferry, or the like.

The marine vessel 100 is adapted to operate at bodies of water, e.g., a sea, ocean, lake, river, bay, gulf, strait, channel, reservoir, fjord, marsh, swamp, etc. The marine vessel 100 may be an electric marine vessel, gasoline-powered marine vessel, diesel-powered marine vessel, or the like, provided it can be maneuvered using an input device having a joystick. The marine vessel comprises a marine maneuvering system 5, which is a marine EVC being adapted to control operations of the marine vessel 100.

The marine maneuvering system 5 comprises one or more proximity sensors 10, in this particular example six. The proximity sensors 10 may be distributed at arbitrary positions of the marine vessel 100. In this example a first pair of sensors 10-1, 10-2 is arranged at a respective back side of the marine vessel 100, a second pair of sensors 10-3, 10-4 is arranged at a respective center side of the marine vessel 100, and a third pair of sensors 10-1, 10-2 is arranged at a respective front side of the marine vessel 100. The proximity sensors 10 may be arranged at any suitable height of the marine vessel 10, both over the surface or as underwater sensors. In other examples the proximity sensors 10 can be arranged anywhere at the marine vessel 100 provided that they are able to sense portions of the surroundings of the marine vessel 100. For underwater placement of the proximity sensors 100, the sensed portions refer to underwater areas, i.e. below the surface. The proximity sensors 100 are configured to sense at least portions of an environment 102 surrounding the marine vessel 100. The environment 102 is typically a body of water (above the surface and/or below the surface), although the environment 102 may also be land when the marine vessel 100 is located within the sensor's proximity reach of the land. "At least portions" of the environment 102 thus refer to spatial locations in the vicinity of the marine vessel 100, where the reachability to the vicinity depend on what type of sensing technique(s) is/are being employed. The environment 102 includes various targets that can be sensed, including but not limited to other marine vessels, living beings (e.g. humans, wildlife), buoys, lighthouses, rock massives, underwater objects, airborne objects, land masses, quays, berths, docking facilities, and many more targets readily envisaged by the skilled person. The proximity sensors 10 may be lidar devices, radar devices, sonar devices, ultrasonic devices, cameras, inductive proximity sensors, capacitive proximity sensors, infrared proximity sensors, and/or other suitable devices configured to be able to sense an environment. In response to sensing a target in the environment 102, the sensors 10 are individually and/or collectively configured to transmit proximity signal(s) to a marine vessel control unit 30, details of which will be further explained soon.

The marine maneuvering system 5 comprises an input device 20. The input device 20 comprises a force feedback device 22 and a joystick 24. The input device 20 shall be understood as a device that can be adapted to provide navigational commands to the marine vessel control unit 30, such as commands pertaining to a speed or direction.

The joystick 24 may comprise a handle, a lever, or some type of maneuverable axle. The joystick 24 may be arranged to be maneuvered by an operator of the marine vessel 100, for example by a hand of the operator. The joystick 24 may be movable in three degrees of freedom, i.e., pitch, roll and yaw. The pitch movement refers to up-and-down movement or rotation of the joystick 24 around a horizontal axis, i.e., around the transverse axis which is an imaginary line running from port (left) to starboard (right) across the width of the marine vessel 100. The roll movement refers to side-to-side movement or rotation of the joystick 24 around a longitudinal axis which is an imaginary line running from the bow (front) to the stern (back) of the marine vessel 100. The yaw movement refers to left-and-right movement or rotation of the joystick 24 around a vertical axis, and corresponds to a turning or twisting motion of the marine vessel 100 by a change of direction or heading. These three degrees of freedom allow the joystick 24 to control motion and orientation of the marine vessel 100 in three-dimensional space.

The joystick 24 is arranged to be movable, for example between positions that herein are referred to as an equilibrium position and one or more displaced positions. The equilibrium position shall be understood as a neutral or default position which the joystick 24 is assuming upon no external forces are exerted on the joystick 24. In some examples, the external forces are user-applied forces. In these examples, it is therefore understood that no user-applied force exertion on the joystick 24 causes the joystick 24 to be maintained at the equilibrium position. This is unless some other movement resistance is being applied to the input device 20, for instance by the force feedback device 22. The equilibrium position is typically a centered position of the joystick 24 in relation to its mechanical end positions defined by physical limitations of the joystick 24. However, other joystick designs may involve other positional details of equilibrium positions. The displaced position shall be understood as a position being displaced from the equilibrium position. The displaced position may correspond to mechanical end positions of the joystick 24 defined by physical limitations of the joystick 24. The displaced position may correspond to an arbitrary position in between the equilibrium position and a mechanical end position.

The joystick 24 may comprise a positional sensor (not shown) being configured to determine positional data of the joystick 24. This information may be used to determine whether the joystick 24 is in a displaced position or an equilibrium position. The positional sensor may be a potentiometer, hall effect sensor, optical encoder, capacitive sensor, resistive film sensor, magnetic sensor, and the like.

The force feedback device 22 is adapted to apply a force feedback to the joystick 24. The force feedback may be applied in the form of haptic feedback, which corresponds to physical sensations or forces to a user in response to their interactions with the joystick 24. The force feedback device 22 is thus adapted to provide force feedback in response to the operator of the marine vessel 100 maneuvering the joystick 24 between the various positions as discussed above.

The force feedback may be applied by adjusting a movement resistance of the joystick 24. The force feedback device 22 may be a mechanical device and/or an electrical device. In non-limiting examples, force feedback device 22 may comprise an electric motor, an actuator, a piezoelectric device, a hydraulic device, a pneumatic device, a shape memory alloy, an electromagnetic device, a mechanical linkage, or the like. In examples where the joystick 24 is movable in three degrees of freedom, the force feedback device 22 may comprise a respective force feedback unit for each degree of freedom. It is therefore possible to target force feedback application to selective portions of the joystick 24 (e.g. through one or more of the force feedback units). The force feedback device 22 may be integrated into the joystick 24, or be provided externally to the joystick 24 but configured to transmit the force feedback through connection with the joystick 24. For external use, the force feedback device 22 may involve an external controller that is configured to transmit signals to a controller of the joystick 24 such that force feedback can be generated therein.

The resistance of movements of the joystick 24 may be adjusted by a fixed force value or a variable force value. For example, consider the scenario where a navigation request involving a speed value of 10000 is requested. By applying a fixed force value, this would mean that the value of 10000 be immediately reduced to a lower specific value, such as 8000. For a variable force value, the speed value of 10000 can instead be gradually reduced from 10000 to 8000, for example via intermediary values of 9500, 9000, 8500, or generally at any arbitrary subinterval with a granularity appropriate for the current driving situation. The variable force value may be an integrated value over time, for example functioning as a proportional-integral-derivative controller (PID). To this end, the magnitude and direction of the force value may vary or not depending on the type of force value being applied.

In order to provide the force feedback, the direction of the force value is typically opposite from the movement direction of the joystick 24, or the upcoming movement direction that is associated with a navigational request. For instance, movements by the joystick 24 from the displaced position to the equilibrium position may involve an applied force value in a direction from the equilibrium position towards the displaced position. Since the force value may vary, the force value may cause different movement speeds of the joystick 24 from the displaced position to the equilibrium position. The force value may completely counteract the movement of the joystick 24 from the displaced position towards the equilibrium position, thereby locking the joystick 24 in place. The force value may also be sufficiently small such that movement of the joystick 24 is allowed from the displaced position towards the equilibrium position. This may be done at varying magnitudes such that the movement speed of the joystick 24 varies.

The marine maneuvering system 5 comprises a marine vessel control unit 30. The marine vessel control unit 30 is operatively connected to the proximity sensor(s) 10 and the input device 20. The marine vessel control unit 30 may comprise processing circuitry of a computer system of the marine vessel 100. The marine vessel control unit 30 is configured to obtain a requested movement of the joystick 24 indicating a speed value and a direction value for an upcoming navigation of the marine vessel 100. The marine vessel control unit 30 is configured to obtain one or more proximity signals from the proximity sensor(s) 10 in response to at least one target being sensed in the environment 102 at least towards a direction indicated by the direction value. The marine vessel control unit 30 is configured to determine a distance between the marine vessel 10 and the at least one target based on the one or more proximity signals. The marine vessel control unit 30 configured to control the force feedback device 22 to apply a force feedback to the joystick 24 based on the determined distance. Various examples and explanations of these functionalities performed by the marine vessel control unit 30 will be described later on in this disclosure.

The marine vessel control unit 30 may be configured to obtain a longitudinal speed of the marine vessel 100. The longitudinal speed may be obtained in at least near real-time, meaning that the longitudinal speed may be continuously (or at least repeatedly) obtained. The longitudinal speed is the speed at which the marine vessel 100 moves forward or backward along its length, as is also known as the speed-through-water. The longitudinal speed may be obtained through any known ways of obtaining a longitudinal speed of a marine vessel, such as inputs from one or more of a speed sensor, an engine revolution sensor, a positioning system, a navigation system, a fleet management system, a light detection system, a radar detection system, a sonar detection system, or a nautical chart, or the like. In some examples, the marine vessel control unit 30 may be configured to set a longitudinal speed threshold value. In these examples, the control unit 40 may be configured to control the force feedback device 22 based on an outcome of a comparison between the longitudinal speed and the longitudinal speed threshold value. The longitudinal speed threshold value may be a fixed value, such as 2, 5, 10, or 20 knots, or any other similar speed value typically associated with marine vessels. The fixed value may relate to one or more speed constraints for the marine vessel 100. The speed constraints may be vessel limitations or external limitations. Vessel limitations pertain to properties of the marine vessel 100, and may include one or more of a hull design, a maximum power output, a weight, a dimensional property, or the like, of the marine vessel 100. External limitations pertain to properties surrounding the marine vessel 100 which, directly or indirectly, affect the speed of the marine vessel 100, and may include one or more of sea conditions, weather conditions, navigation rules, environmental rules, and the like.

The marine maneuvering system 5 comprises one or more auxiliary sensors, in this example being an inertial measurement unit (IMU) 118 and a position sensor (PS) 119. The IMU 118 is configured to provide real-time information about the orientation, acceleration and/or angular velocity of the marine vessel 100. The PS 119 is configured to provide geographical coordinates of the marine vessel 100, e.g. GPS/GNSS data.

The marine vessel 100 comprises a propulsion system 110. The propulsion system 110 is responsible for generating power required to propel the vessel through bodies of water. The design and operation of the propulsion system 50 may vary depending on the type of vessel, for instance involving electrical engines, a diesel engine, a gas turbine, a steam turbine, or water jets. The present disclosure is primarily concerned with electrical propulsion systems. This particular propulsion systems 110 shows one type of electric propulsion system which is controllable through computer control. The propulsion system 110 is adapted to cause movement of the marine vessel 100 in one or more of the three degrees of freedom as discussed above. The propulsion system 110 can in various non-limiting implementations involve a number of different units. In this particular example, the propulsion system 110 includes a pair of engines 112-1, 112-2, gears 114-1, 114-2 and rudders 116-1, 116-2. The propulsion system 110 involves the coordination of the engines 112-1, 112-2, gears 114-1, 114-2, and rudders 116-1, 116-2 in response to navigational instructions from the marine vessel control unit 30, e.g. via a helm system 40. The engines 112-1, 112-2, which can be AC or DC motors, in some examples brushed DC motors, are controlled by a throttle that adjusts the speed by regulating engine revolutions. The engines 112-1, 112-2 may involve a power source, such as a battery system, fuel cell system or another energy system. The power source may be chargeable, for instance when the marine vessel 100 is connected to an external power supply. The external power supply may be an on-shore or off-shore power facility. The power source may be a solar system of the marine vessel 100. The power source may be a fuel cell stack of the marine vessel 100. The gears 114-1, 114-2, often part of a transmission system (not shown), enable forward and backward movement, allowing the boat to navigate in different directions. The rudders 116-1, 116-2, typically located at the stern of the marine vessel 100, is used for steering by altering the water flow around the hull of the marine vessel 100 to change the direction of the marine vessel 100. The marine vessel control unit 30 integrates these components, thereby allowing the operator of the marine vessel 100, for example by maneuvering the joystick 24, to manipulate throttle and steering inputs.

Although not explicitly shown in FIG. 1, the skilled person will appreciate that the marine vessel 100 may include additional (sub) systems typically found in marine vessels, such as electrical systems, navigational systems, ballast systems, steering systems, HVAC systems, infotainment systems, hydraulic systems, safety systems, communication systems, auxiliary sensory systems, and so forth.

The marine maneuvering system 5 comprises a helm station 40. The helm station 40 is operatively connected to the components of the marine maneuvering system 5, and serves as a control point for navigation and operation. The control may relate to the marine vessel control unit 30, the IMU 118, the PS 119, the propulsion system 110, or any of the additional (sub) systems referred to above.

Although not explicitly shown, it shall be assumed that the various lines in FIG. 1 refers to various interfaces or peripherals in which the components communicate with one another. For these purposes, any wired or wireless communication standards known in the art may be employed. Wireless communication standards may include IEEE 802.11, IEEE 802.15, ZigBee, WirelessHART, WiFi, Bluetooth®, BLE, RFID, WLAN, MQTT IoT, CoAP, DDS, NFC, AMQP, LoRaWAN, Z-Wave, Sigfox, Thread, EnOcean, mesh communication, or any other form of proximity-based device-to-device radio communication signal such as LTE Direct. Wired communication standards may include Controller Area Network (CAN), Ethernet, Hybrid Communication Unit (HCU), Gigabit Multimedia Serial Link (GMSL), Local Interconnect Network (LIN), FlexRay, Media Oriented Systems Transport (MOST), Universal Serial Bus (USB). The choice of communication standard may depend on data transfer requirements, real-time capabilities, and specific needs of the various components. It shall be appreciated that the scope of the present disclosure is by no means limited to a particular communication standard.

Figure 2:
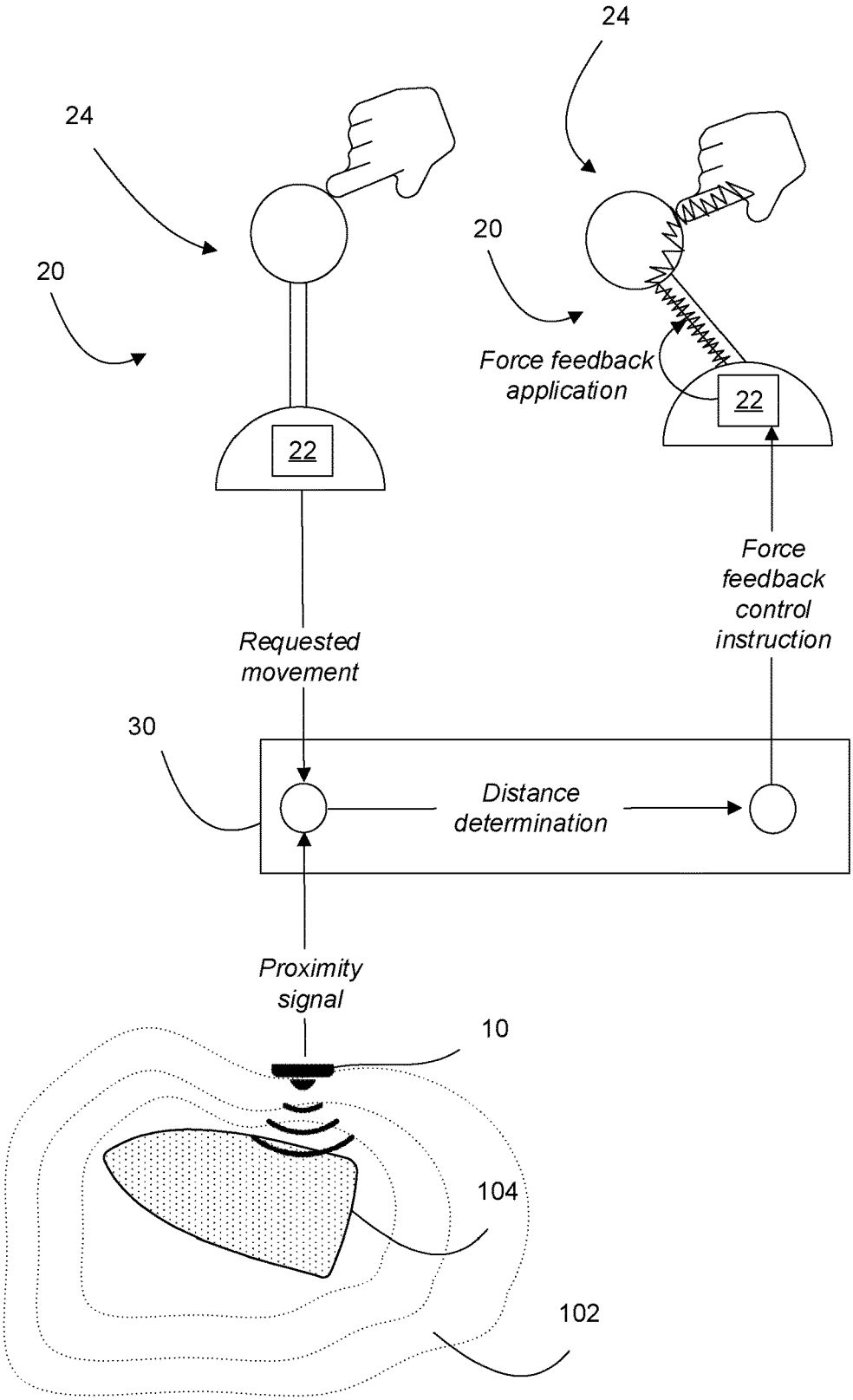
FIG. 2 is a schematic illustration of a distance-based force feedback control of a marine vessel joystick, according to an example.

With further reference to FIG. 2, an exemplary distance-based control of force application is schematically visualized. The events indicated in italics refer to actions carried out by the marine vessel control unit 30, which will now be further described according to further examples of the present disclosure.

The first step is to, by the marine vessel control unit 30, obtain a requested movement from the joystick 24. The requested movement indicates a speed value and a direction value for an upcoming navigation of the marine vessel 100. It shall therefore be understood that a requested movement is not the same as an actual movement. This event occurs before controllers of the marine vessel 100 have made any action as regard if and how propulsion and/or steering shall be actuated. The requested movement is typically obtained in response to an operator of the joystick 24 applying a force to the joystick 24, for example from its equilibrium position towards a displaced position. However, it can also occur automatically, for example in autopilot mode, in automatic docking mode, or in other driving modes of the marine vessel 100 conceivable by the skilled person where the joystick 24 can be automatically controlled. The requested movement may vary depending on a type of operation, such as requests pertaining to acceleration, deceleration, steering, rotation, position holding, station keeping, thruster control, automatic docking, autopilot, course corrections, heading control, speed control, anchoring, mooring, emergency maneuvers, or the like.

The magnitude of the force applied to the joystick 24 will indicate the speed value. The marine vessel control unit 30 may therefore be configured to translate the force applied to the joystick 24 to the speed value, for example based on data obtained by the positional sensor of the joystick 24 as described above. Purely by way of example, a maximally maneuvered joystick 24 (as defined by physical limitations) may indicate a maximum speed value of 10000, no maneuvering of the joystick 24 at all may indicate a speed value of 0, and any force application therebetween may correspond to speed values between 0 and 10000. Thus, a force application of 2/10 of a maximum possible force application may correspond to a speed value of 2000, while a force application of 5/10 of a maximum possible force application may correspond to a speed value of 5000, and so forth.

The way the joystick 24 is maneuvered will indicate the direction value. The marine vessel control unit 30 may therefore be configured to translate the directional input applied to the joystick 24 to the direction value. Purely by way of example, a joystick 24 maneuvered from a left position to a right position (rolling movement) may indicate a direction value of 90° originating from a current forward-facing direction of the marine vessel 100. In another example, a joystick 24 maneuvered by rotation ¼ to the left originating from an equilibrium position (yawing movement) may indicate a direction value of a 90° counter-clockwise rotation of the marine vessel 100 from a current forward-facing direction of the marine vessel 100. In addition to the above, the direction value may indicate directions in more than one dimension. Therefore, it should be understood that the direction value may indicate one or more of a requested pitching rotation, yawing rotation, or rolling rotation of the marine vessel 100. The skilled person will appreciate that any reasonable requested movements provided by the joystick 24, including both speed values and/or direction values, may be envisaged in a similar way, none of which are to be understood as limiting to the scope of the present disclosure.

The second step is to, by the marine vessel control unit 30, obtain proximity signals from a proximity sensor 10. These are obtained in response to a target 104 being sensed in the environment 102, in this case a body of water, at least towards a direction indicated by the direction value. For illustrative purposes the marine vessel 100 is not explicitly shown in the visualization of FIG. 2, although it is assumed that the marine vessel 100 is within sufficient distance from the target 104 to cause the one or more proximity signals to be obtained. Since the requested movement includes the direction value, this step thus has a prerequisite that a requested movement has been obtained from the joystick 24. This is due to the fact that the marine vessel control unit 30 will, at a later stage, seek to determine whether there is, for example, a risk of colliding with the target 104 in the requested direction, and accordingly perform distance-based control of force feedback. However, in some cases other directions not immediately requested by the requested movement may become relevant as well for purposes of upcoming navigations. This may be the case in an example where the operator requests a clockwise rotation of the marine vessel 100, which involves both a consideration of a back-left side of the marine vessel 100 and a front-right side of the marine vessel 100 due to the rotational nature of the movement. Hence, the marine vessel control unit 30 considers target sensing at least towards the direction indicated by the direction value, but in some cases as apparent given the above discussion also additional directions not directly indicated by the direction value, but indirectly so.

The third step is to, by the marine vessel control unit 30, determine a distance between the marine vessel 100 and the target 104 based on the one or more proximity signals. The determined distance may be interpreted as a safety distance to avoid a hazard, in this case the target 104. In some examples, the distance may be calculated from a position of a proximity sensor 10 from which the proximity signals were obtained. In some examples, the distance may be calculated from a weighted origin position, for instance a center point of the marine vessel 100. The distance may be calculated using a distance function, such as by calculating the Euclidean distance d from an origin point (the position x1, y1 of the marine vessel 100) to a target point (the position x2, y2 of the target 104) in 2D space, i.e., $d=\sqrt{(x2-x1)^2+(y2-y1)^2}$. Sometimes distance calculations in 3D space may be realized, for example when determining a distance to an underwater object or an airborne object. The origin position may be determined by the PS 119 as discussed with respect to FIG. 1. The distance may in some examples be calculated by the proximity sensor 10, for example upon said proximity sensor 10 being a lidar device. The lidar device may in these examples perform time-of-flight calculations based on a time it takes from a light emission until the light reflected back from the target 104 reaches a sensor of the lidar device. Therefore, in these examples the distance may be determined by the marine vessel control unit 30 by way of obtaining the already calculated distance from the proximity sensor 10. The proximity sensor 10 is thus a "smart" proximity sensor 10 in the sense that it may involve other functionality than sensing the target 104. For a "dumb" proximity sensor 10, the target may be sensed, signals sent to the marine vessel control unit 10, and distance calculations be performed therein for purposes of determining the distance. Other variations may be realized, and the distance is not limited to one particular type of calculation method.

In examples where the proximity signals indicate that there are a plurality of targets present in the environment 102 towards at least a direction indicated by the direction value, the marine vessel control unit 30 may be configured to determine a distance between the marine vessel 100 and each one of the plurality of targets. To this end, a plurality of distances are respectively determined, and can be considered individually or in combination for further control of the force feedback device 22.

The fourth step is to, by the marine vessel control unit 30, control the force feedback device 22 to apply a force feedback to the joystick 24 based on the determined distance. In FIG. 2 this step is shown as two separate events. The first event involves submitting, by the marine vessel control unit 30, one or more instructions to the force feedback device 22 based on the distance. This shall be understood as a control signal. The second event involves, by the force feedback device 22, responding to the control signal and carry out the force feedback application to the joystick 24. The force feedback is illustrated in FIG. 2 as physical sensations from the base of the joystick 24, up through the handle thereof and into the hand of the operator. Together, these two events form a controlled actuation of the force feedback device 22. Accordingly, the operator is intuitively notified of the presence of the target 104 within an unsafe distance from the marine vessel 100 through the physical sensations, and will experience a higher (or lower for safe distances) resistance when trying to operate the joystick 24.

In some examples, controlling the force feedback device 22 based on the determined distance may involve a three-step procedure. The three-step procedure involves a first step of calculating a maximum allowed speed for the marine vessel 100 based on the determined distance. The maximum allowed speed corresponds to an allowed propulsion of an upcoming navigation for the marine vessel 100 without e.g. risking a collision or some other hazardous event. The maximum allowed speed may be based on one or more operating conditions of the marine vessel 100. The operating conditions may be a propulsion property (e.g. maximum possible energy throughput), a braking property (e.g. maximum possible braking power), a size or weight of the marine vessel 100, a driving mode of the marine vessel 100 (e.g. whether the marine vessel 100 is operating in an auto docking mode or in an adaptive cruise mode), or the like. The maximum allowed speed may additionally or alternatively be based on ambient conditions of the environment 102. The ambient conditions may relate to prevailing weather conditions (e.g. if wind strengths, wave heights, temperatures, precipitation, etc., exceed or fall short of respective predetermined safety threshold values), speed zones (e.g. in quay area, berthing facility, neritic zone, oceanic zone), or the like. The speed zones may be determined by a navigational chart or obtained from a database storing information pertaining to maximum allowed speeds in various geographical areas.

A second step of the three-step procedure referred to above involves translating the maximum allowed speed into a maximum allowed joystick movement. Since the marine vessel control unit 30 is aware of the maximum allowed speed of the marine vessel 100, it is also known how to translate this into a joystick movement that does not surpass said maximum allowed speed. This is referred to as the maximum allowed joystick movement. Based on the maximum allowed joystick movement, the third step of the three-step procedure involves limiting the requested movement of the joystick 24 based on the maximum allowed joystick movement. In some examples, the limitation of the requested movement of the joystick 24 may be carried out by controlling the force feedback device 22 to apply a force feedback that counteracts a force of the requested movement. To this end, the applied force feedback is greater than the force applied to the joystick 24 that caused initiation of the requested movement.

The above three-step procedure will now be explained according to one possible example. It shall be noted that this example is just for explanatory purposes and shall by no means be construed as limiting to the scope of the present disclosure. Many other similar examples may appear, with other target(s), distance(s), speed(s), etc., that in some way affect the way the force feedback device 22 is controlled to apply the force feedback to the joystick 24. In this example it has been determined that the marine vessel 100 is within 100 meters of the target 104. The target 104 is another moving vessel that is on its way to pass the marine vessel 100 from a front-right towards a front-left position in relation to the marine vessel 100. In order to allow for the moving vessel to pass without a collision occurring in an upcoming navigation, it has been determined that the marine vessel 100 should not exceed a speed of 5 m/s in the forward direction as indicated by the direction value. To this end, if the marine vessel 100 continues with a maximum allowable speed of 5 m/s, it will take approximately 20 seconds for the marine vessel 100 to reach the location of the moving vessel (5 m/s*20s=100 m), which will by then have moved away from said location to the front-left position. The marine vessel control unit 30 will know what output value of the joystick 24 can cause a speed of the marine vessel 100 to exceed 5 m/s, and any movement request of the joystick 24 identified which exceeds this output value will thus be limited based on the maximum allowed joystick value. It shall be understood that the control is not necessarily carried out according to this approach, since the force feedback is not necessarily applied in a uniform manner, as will be apparent given some of the examples below.

In some examples, the marine vessel control unit 30 may be configured to control the force feedback device 22 to gradually increase the applied force the smaller the distance between the marine vessel and the target 104 is. The gradual increase may in some examples be associated with a varying value, thus being an accelerated gradual increase. The same could be realized for the opposite situation. The opposite situation would be that the applied force feedback is higher the longer the distance between the marine vessel 100 and the target 104 is. Thus, higher/lower force feedback is applied to the joystick 24 the more/less imminent the dangerous situation is, due to a closer/longer distance to the target 104. In the example above this would mean that, for instance, for the first 50 m the marine vessel 100 may be allowed to surpass a speed of 5 m/s, but in that case the last 50 m would require a greater limitation to the movement of the joystick 24 such that the marine vessel 100 would be below 5 m/s. This may be controlled based on the prevailing situation and may be changed during navigation. For example the proximity sensor 10 may indicate through additional proximity signals that the moving vessel moves quicker than anticipated, e.g. due to an acceleration, which can thus lead to a lower force feedback application.

In some examples, the marine vessel control unit 30 may be configured to control the force feedback device 22 to gradually increase the applied force the higher the speed value is. The gradual increase may in some examples be associated with a varying value, thus being an accelerated gradual increase. The same could be realized for the opposite situation. The opposite situation would be that the applied force feedback is lower the lower the speed value is. Thus, higher/lower force feedback is applied to the joystick 24 the higher/lower the speed value is.

In some examples, the marine vessel control unit 30 may be configured to control the force feedback device 22 based on navigable water conditions where the marine vessel 100 is traveling. Navigable water conditions may be any condition of the water that can affect the way the joystick 24 is operated. For example, a wind speed, wave height and/or strength of currents of the water may affect how much force that needs to be applied to the input source 20 in order to control its behaviour. Other conditions may include weather conditions, such as a water temperature and a presence of ice. The marine vessel control unit 30 may be configured to set predefined threshold values associated with one or more of the navigable water conditions. The predefined threshold values may define limits for how the joystick 24 shall be operable based on the prevailing conditions. The marine vessel control unit 30 may be configured to obtain current navigable water conditions and compare these against the respective predefined threshold values, and carry out control of the force feedback device 22 accordingly. In some examples, certain requested movements of the joystick 24 may be ignored in response to the navigable water conditions being above respective predefined threshold values. Ignoring certain requests may be useful in situations where said requests are triggered inadvertently. Such inadvertent request triggering may be a consequence of a navigable water condition affecting the maneuverability of the joystick 24, for instance causing violent shaking on the marine vessel 100 such that the operator loses the grip on the joystick 24, or triggers an unexpected force application thereto. In some examples, movement requests may be responded to by relevant control of the force feedback device 22 in response to the navigable water conditions being below or equal to respective predefined threshold values. This may correspond to a normal behaviour where no excessive navigable water conditions are envisaged.

In some examples, the applied force feedback may be overridable by an applied external force to the joystick 24 which exceeds a value of the force feedback. This may be useful in certain scenarios where the operator of the joystick 24 wants to overtake control of the joystick 24. Such scenarios may involve in case of erroneous sensor readings (e.g. a false detection of a target that does not exist causing an unnecessary force feedback application), advanced driving situations where the operator cannot rely on the sensor readings, or the like.

In some examples, the marine vessel control unit 30 may be configured to cause control of the force feedback device 22 based on a classification of the target 104. As discussed above, the target 104 is not limited to a particular type, so the marine vessel control unit 30 may in these examples determine one or more classifications thereof by processing the proximity signals. Determining a classification of a target may be performed in examples where the proximity sensor 10 is capable of capturing images of the target 104, for instance when they are embodied as cameras. The proximity signals may thus include, or be accompanied with, one or more images. The classification determination may be done by applying an image processing algorithm to these images. The image processing may be carried out by the marine vessel control unit 30 and/or the proximity sensor 10 (for instance in examples where the proximity sensors 10 are smart sensors having computing capabilities). Image processing algorithms known in the art for these purpose may involve convolutional neural networks (CNN), support vector machines (SVM), k-nearest neighbors (KNN), decision trees, random forests, feature extraction techniques, image segmentation, transfer learning, or the like.

The classification may comprise one or more of a mobility attribute, a size attribute, a mass attribute, a living attribute or a material composition attribute. Based on what type of classification is set, the force feedback application may be controlled accordingly. For instance, it may be necessary to employ additional safety restrictions when the target 104 has been classified as a moving object, as opposed to a stationary object, by the mobility attribute, since it may involve an increased safety risk. In another example smaller objects, as opposed to larger objects, as indicated by the size attribute may not require as high force feedback since these can potentially be ignored (e.g. if it is a small fish). A mass attribute may be viewed in a similar way. In yet another example, a living object (such as a floating human), may require immediate action and higher force feedback application compared to a non-living object (such as a buoy). In a further example, certain material compositions (e.g. flammable objects) are typically associated with higher risks, so the control may be based accordingly.

In examples where objects are associated with a plurality of classifications, a weighted value of said plurality of classifications may be calculated, and control may be carried out accordingly. To this end, additional safety measures may be provided. For example, it may be even more dangerous if a human person is identified (by the living attribute), which is also swimming towards the marine vessel 100 (by the mobility attribute).

FIG. 2 has now been discussed to some extent according to various examples. One or more of these examples may be applicable also to the exemplary traffic scenario depicted in FIG. 3, which will now be discussed to some extent.

Figure 3:
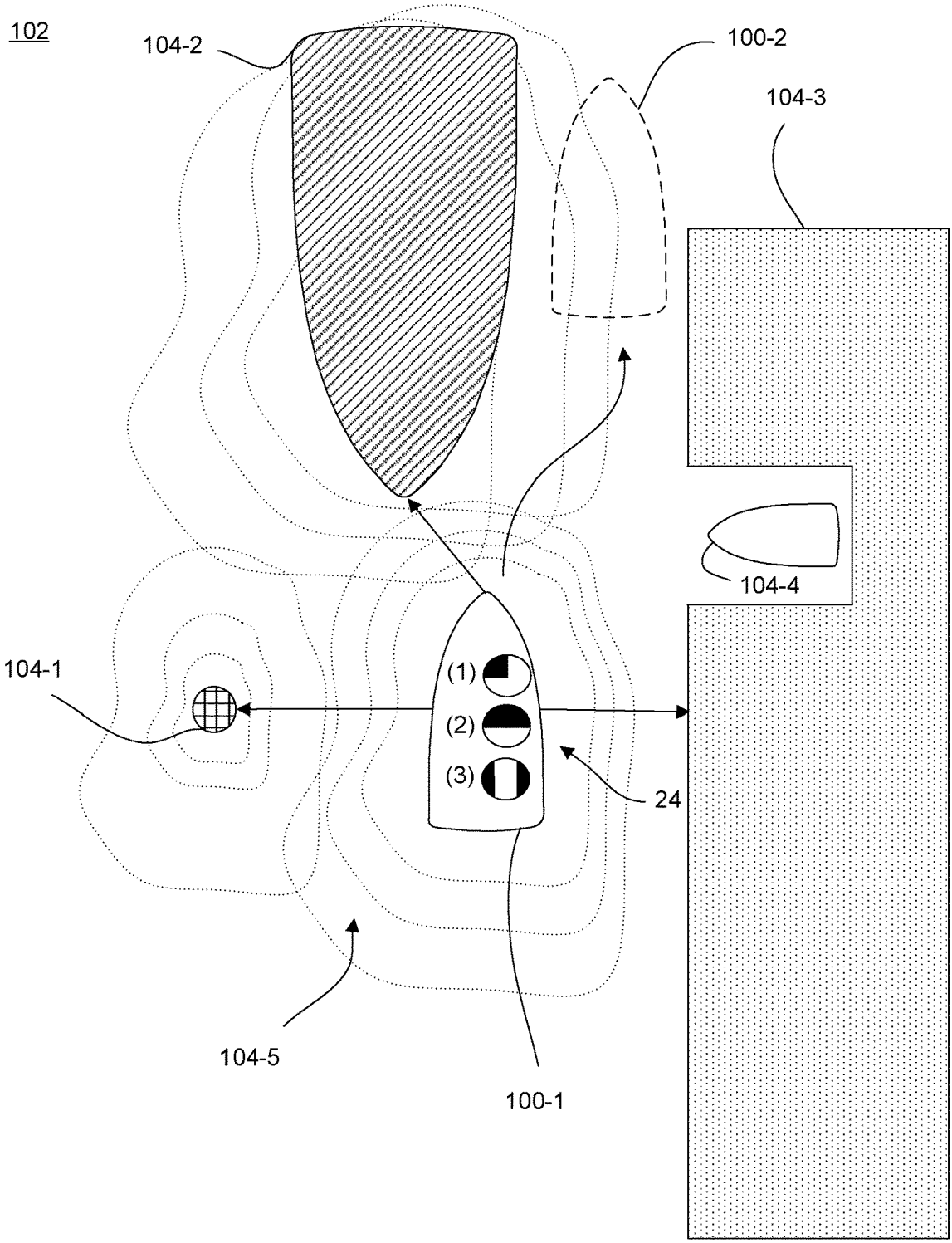
FIG. 3 is a schematic illustration of a distance-based force feedback control of a marine vessel joystick in an exemplary situation where many targets are present in the environment, according to an example.

FIG. 3 illustrates a top view of a traffic scenario. The marine vessel 100 travels on a body of water in the environment 102. In the current visualization the marine vessel 100 is located at a first position 100-1, and desires to move to a second position 100-2 by avoiding any possible dangers that may arise. The operator of the marine vessel 100 will be notified by these dangers through force feedback applied to joystick 24 by way of control as has been discussed herein. In the environment 102, a plurality of targets 104 are apparent. The targets 104 include a buoy 104-1, a larger ship 104-2, a quay 104-3, a smaller vessel 104-4 and waves 104-5 on the body of water. In order to arrive at the second position 100-2, the marine vessel 100 will have to navigate through these different targets.

It has been determined that the buoy 104-1, the smaller vessel 104-4 and the waves 104-5 are not of relevance for this particular requested movement, since they are not present in a direction indicated by the direction value. Although the proximity signals will sense the buoy 104-1 and the waves 104-5, due to the requested movement causing a rotation of the marine vessel 100 such that its stern is at least partly facing the buoy 104-1 and the waves 104-5, the buoy 104-1 will be too far away and the waves 104-5 have been classified as not large enough to require force feedback application. The smaller vessel 104-4 will not appear in the direction requested by the direction value so it will not be sensed.

In view of the above, the sensed targets are the larger ship 104-2 and the quay 104-3. In this particular example, the force feedback will accordingly be applied in two different ways, as indicated in FIG. 3 by (1) and (2). The first force feedback will be applied when the marine vessel 100 is passing the larger ship 104-2 at its left side from the view shown in FIG. 3, optionally gradually higher the closer the larger ship 104-2 gets to the marine vessel 100. The force feedback is thus preferably applied to a front left portion of the handle of the joystick 24, as indicated by (1). The second force feedback will be applied when the marine vessel 100 is approaching the quay 104-3 at its bow. This will indicate danger directly in front of the marine vessel 100, and thus preferably cause a force feedback application to a front portion of the handle of the joystick 24, as indicated by (2).

In some examples, a control of a lingering force feedback application may be applied. This may be performed by the marine vessel control unit 30. In this particular example this is performed as a lingering effect after the first two force feedback applications have been applied, which further lingers the force feedback after the two targets 104-2, 104-3 have been circumvented. This indicated by (3). In these examples, some final force feedback may be applied to respective side portions of the handle of the joystick 24 such that the operator may receive feedback of the targets that have been passed successfully and are now located at respective sides (left and right) of the marine vessel 100. To this end, the marine vessel control unit 30 may in some examples be configured to cause control of the force feedback device 22 to cause a lingering force feedback effect. The portion on the handle where the lingering force feedback effect is applied may vary compared to the original portion of the force feedback effect, as is indicated in this example, or be the same. The lingering force feedback effect is typically lower than the previous force feedback, as it may indicate that the danger is not as imminent as it previously was. The portion on the handle where the lingering force feedback is applied may shrink over time the further away the marine vessel 100 gets from the sensed targets, until force feedback is fully diminished. The operator may thus advantageously receive feedback of a danger that has been successfully averted through the joystick 24. These examples may be understood as providing force feedback that "follows" the movement of the marine vessel 100 in relation to the sensed targets 104-2, 104-3.

Figure 4:
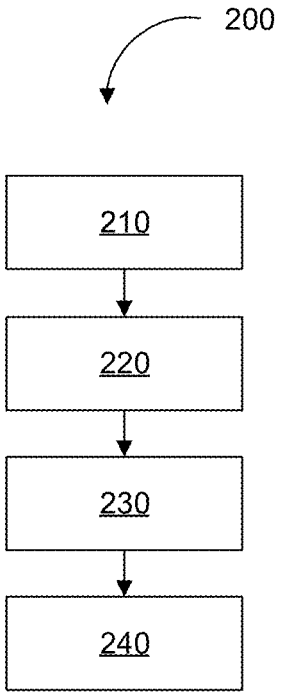
FIG. 4 is a flowchart of an exemplary method for controlling force feedback application of a marine vessel joystick, according to an example.

With further reference to FIG. 4, a computer-implemented method 200 for a marine vessel 100 is shown. The method 200 may be implemented by processing circuitry of the marine vessel control unit 30 as discussed herein. The method 200 involves obtaining 210 a requested move movement of a joystick 24, the requested movement indicating a speed value and a direction value for an upcoming navigation of a marine vessel 100. The method 200 involves obtaining 220 one or more proximity signals from a proximity sensor 10 in response to at least one target 104 being sensed in the environment 102 at least towards a direction indicated by the direction value. The method 200 involves determining 230 a distance between the marine vessel 100 and the at least one target 104 based on the one or more proximity signals. The method 200 involves controlling 240 a force feedback device 22 to apply a force feedback to the joystick 24 based on the determined distance.

Figure 5:
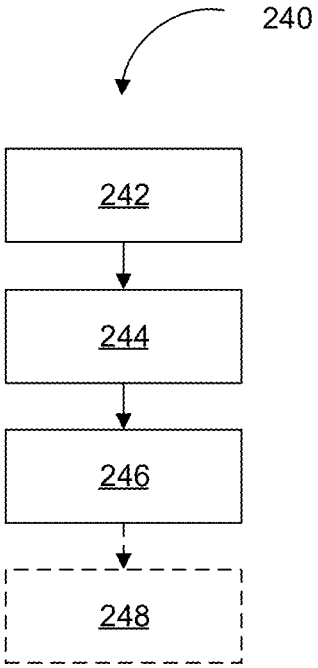
FIG. 5 is a flowchart of an exemplary method for controlling force feedback application of a marine vessel joystick, according to an example.

With further reference to FIG. 5, the controlling 240 as shown in FIG. 4 is detailed according to one example. The controlling 240 comprises calculating 242 a maximum allowed speed for the marine vessel 100 based on the determined distance. The controlling 240 comprises translating 244 the maximum allowed speed into a maximum allowed joystick movement. The controlling 240 comprises limiting 246 the requested movement of the joystick 24 based on the maximum allowed joystick movement. In some examples, the limiting 246 may involve controlling 248 the force feedback device 22 to apply a force feedback value that counteracts a force of the requested movement.

Figure 6:
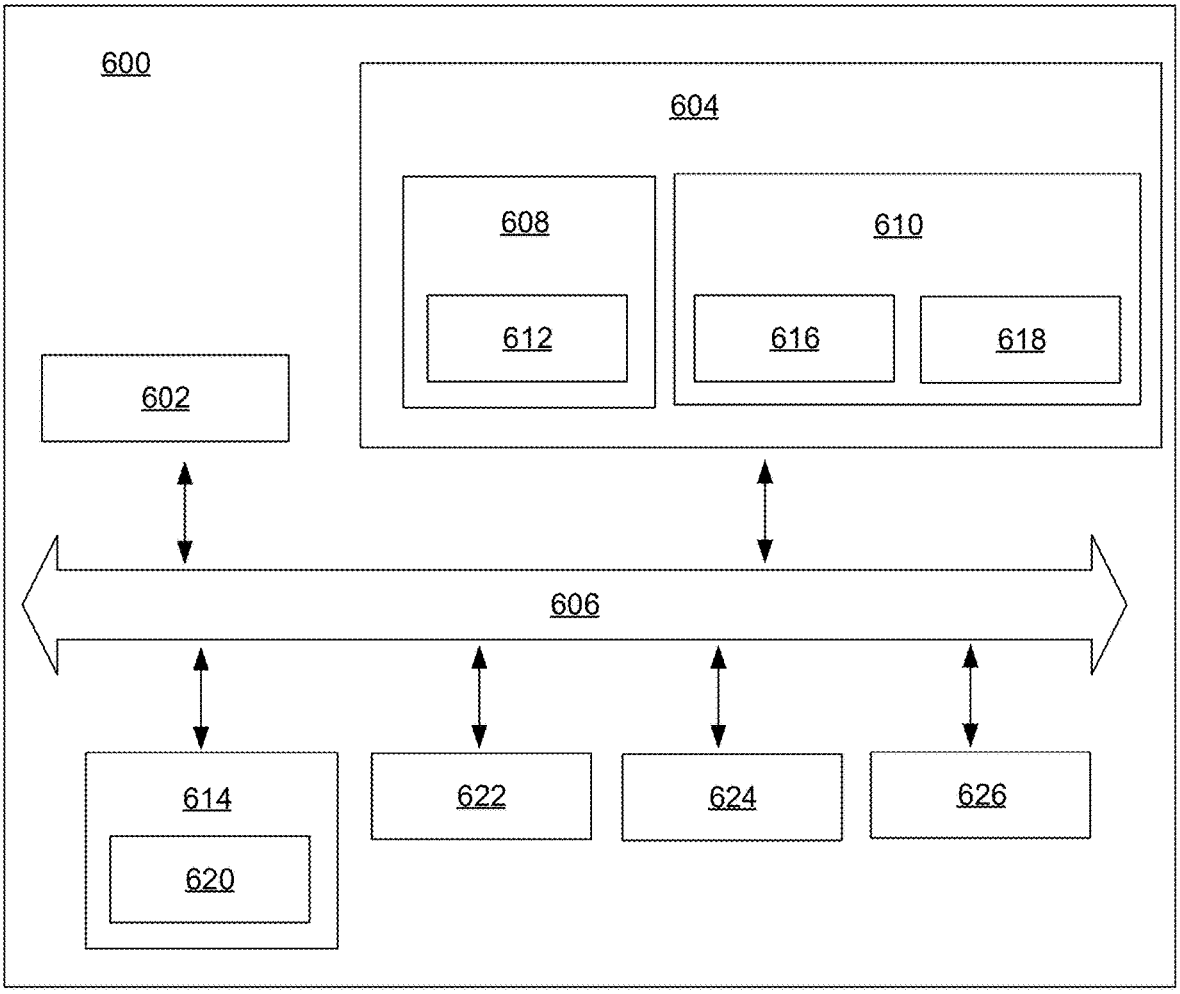
FIG. 6 is a schematic diagram of an exemplary computer system for implementing examples disclosed herein, according to an example.

FIG. 6 is a schematic diagram of a computer system 600 for implementing examples disclosed herein. The computer system 600 is adapted to execute instructions from a computer-readable medium to perform these and/or any of the functions or processing described herein. The computer system 600 may be connected (e.g., networked) to other machines in a LAN (Local Area Network), LIN (Local Interconnect Network), automotive network communication protocol (e.g., FlexRay), an intranet, an extranet, or the Internet. While only a single device is illustrated, the computer system 600 may include any collection of devices that individually or jointly execute a set (or multiple sets) of instructions to perform any one or more of the methodologies discussed herein. Accordingly, any reference in the disclosure and/or claims to a computer system, computing system, computer device, computing device, control system, control unit, electronic control unit (ECU), processor device, processing circuitry, etc., includes reference to one or more such devices to individually or jointly execute a set (or multiple sets) of instructions to perform any one or more of the methodologies discussed herein. For example, control system may include a single control unit or a plurality of control units connected or otherwise communicatively coupled to each other, such that any performed function may be distributed between the control units as desired. Further, such devices may communicate with each other or other devices by various system architectures, such as directly or via a Controller Area Network (CAN) bus, etc.

The computer system 600 may comprise at least one computing device or electronic device capable of including firmware, hardware, and/or executing software instructions to implement the functionality described herein. The computer system 600 may include processing circuitry 602 (e.g., processing circuitry including one or more processor devices or control units), a memory 604, and a system bus 606. The computer system 600 may include at least one computing device having the processing circuitry 602. The system bus 606 provides an interface for system components including, but not limited to, the memory 604 and the processing circuitry 602. The processing circuitry 602 may include any number of hardware components for conducting data or signal processing or for executing computer code stored in memory 604. The processing circuitry 602 may, for example, include a general-purpose processor, an application specific processor, a Digital Signal Processor (DSP), an Application Specific Integrated Circuit (ASIC), a Field Programmable Gate Array (FPGA), a circuit containing processing components, a group of distributed processing components, a group of distributed computers configured for processing, or other programmable logic device, discrete gate or transistor logic, discrete hardware components, or any combination thereof designed to perform the functions described herein. The processing circuitry 602 may further include computer executable code that controls operation of the programmable device.

The system bus 606 may be any of several types of bus structures that may further interconnect to a memory bus (with or without a memory controller), a peripheral bus, and/or a local bus using any of a variety of bus architectures. The memory 604 may be one or more devices for storing data and/or computer code for completing or facilitating methods described herein. The memory 604 may include database components, object code components, script components, or other types of information structure for supporting the various activities herein. Any distributed or local memory device may be utilized with the systems and methods of this description. The memory 604 may be communicably connected to the processing circuitry 602 (e.g., via a circuit or any other wired, wireless, or network connection) and may include computer code for executing one or more processes described herein. The memory 604 may include non-volatile memory 608 (e.g., read-only memory (ROM), erasable programmable read-only memory (EPROM), electrically erasable programmable read-only memory (EEPROM), etc.), and volatile memory 610 (e.g., random-access memory (RAM)), or any other medium which can be used to carry or store desired program code in the form of machine-executable instructions or data structures and which can be accessed by a computer or other machine with processing circuitry 602. A basic input/output system (BIOS) 612 may be stored in the non-volatile memory 608 and can include the basic routines that help to transfer information between elements within the computer system 600.

The computer system 600 may further include or be coupled to a non-transitory computer-readable storage medium such as the storage device 614, which may comprise, for example, an internal or external hard disk drive (HDD) (e.g., enhanced integrated drive electronics (EIDE) or serial advanced technology attachment (SATA)), HDD (e.g., EIDE or SATA) for storage, flash memory, or the like. The storage device 614 and other drives associated with computer-readable media and computer-usable media may provide non-volatile storage of data, data structures, computer-executable instructions, and the like.

Computer-code which is hard or soft coded may be provided in the form of one or more modules. The module(s) can be implemented as software and/or hard-coded in circuitry to implement the functionality described herein in whole or in part. The modules may be stored in the storage device 614 and/or in the volatile memory 610, which may include an operating system 616 and/or one or more program modules 618. All or a portion of the examples disclosed herein may be implemented as a computer program 620 stored on a transitory or non-transitory computer-usable or computer-readable storage medium (e.g., single medium or multiple media), such as the storage device 614, which includes complex programming instructions (e.g., complex computer-readable program code) to cause the processing circuitry 602 to carry out actions described herein. Thus, the computer-readable program code of the computer program 620 can comprise software instructions for implementing the functionality of the examples described herein when executed by the processing circuitry 602. In some examples, the storage device 614 may be a computer program product (e.g., readable storage medium) storing the computer program 620 thereon, where at least a portion of a computer program 620 may be loadable (e.g., into a processor) for implementing the functionality of the examples described herein when executed by the processing circuitry 602. The processing circuitry 602 may serve as a controller or control system for the computer system 600 that is to implement the functionality described herein.

The computer system 600 may include an input device interface 622 configured to receive input and selections to be communicated to the computer system 600 when executing instructions, such as from a keyboard, mouse, touch-sensitive surface, etc. Such input devices may be connected to the processing circuitry 602 through the input device interface 622 coupled to the system bus 606 but can be connected through other interfaces, such as a parallel port, an Institute of Electrical and Electronic Engineers (IEEE) 1394 serial port, a Universal Serial Bus (USB) port, an IR interface, and the like. The computer system 600 may include an output device interface 624 configured to forward output, such as to a display, a video display unit (e.g., a liquid crystal display (LCD) or a cathode ray tube (CRT)). The computer system 600 may include a communications interface 626 suitable for communicating with a network as appropriate or desired.

The operational actions described in any of the exemplary aspects herein are described to provide examples and discussion. The actions may be performed by hardware components, may be embodied in machine-executable instructions to cause a processor to perform the actions, or may be performed by a combination of hardware and software. Although a specific order of method actions may be shown or described, the order of the actions may differ. In addition, two or more actions may be performed concurrently or with partial concurrence.

Example 1: A marine maneuvering system (5) for a marine vessel (100), comprising: a proximity sensor (10) configured to sense at least portions of an environment (102) surrounding the marine vessel (100); an input device (20) adapted to provide navigational commands to the marine vessel (100), wherein the input device (20) comprises a movable joystick (24) and a force feedback device (22) being adapted to apply a force feedback to the joystick (24); and a marine vessel control unit (30) operatively connected to the proximity sensor (10) and the input device (20), the marine vessel control unit (30) being configured to: obtain a requested movement of the joystick (24), the requested movement indicating a speed value and a direction value for an upcoming navigation of the marine vessel (100); obtain one or more proximity signals from the proximity sensor (10) in response to at least one target (104) being sensed in the environment (102) at least towards a direction indicated by the direction value; determine a distance between the marine vessel (100) and the at least one target (104) based on the one or more proximity signals; and control the force feedback device (22) to apply a force feedback to the joystick (24) based on the determined distance.

Example 2: The marine maneuvering system (5) of example 1, wherein the marine vessel control unit (30) is further configured to control the force feedback device (22) by: calculating a maximum allowed speed for the marine vessel (100) based on the determined distance; translating the maximum allowed speed into a maximum allowed joystick movement; and limiting the requested movement of the joystick (24) based on the maximum allowed joystick movement.

Example 3: The marine maneuvering system (5) of example 2, wherein the marine vessel control unit (30) is further configured to limit the requested movement of the joystick (24) by controlling the force feedback device (22) to apply a force feedback value that counteracts a force of the requested movement.

Example 4: The marine maneuvering system (5) of any of examples 2-3, wherein the maximum allowed speed is further based on one or more operating conditions of the marine vessel (100).

Example 5: The marine maneuvering system (5) of any of examples 2-4, wherein the maximum allowed speed is further based on one or more ambient conditions of the environment in which the marine vessel (100) is traveling.

Example 6: The marine maneuvering system (5) of any of examples 1-5, wherein the marine vessel control unit (30) is further configured to control the force feedback device (22) to gradually increase the applied force feedback when the distance between the marine vessel (100) and the target (104) is decreasing.

Example 7: The marine maneuvering system (5) of any of examples 1-6, wherein the marine vessel control unit (30) is further configured to control the force feedback device (22) to gradually increase the applied force feedback when the speed value is increasing.

Example 8: The marine maneuvering system (5) of any of examples 1-7, wherein the marine vessel control unit (30) is further configured to control the force feedback device (22) to apply a fixed force feedback value.

Example 9: The marine maneuvering system (5) of any of examples 1-7, wherein the marine vessel control unit (30) is further configured to control the force feedback device (22) to apply a variable force feedback value.

Example 10: The marine maneuvering system (5) of any of examples 1-9, wherein the applied force feedback is overridable by an applied external force to the joystick (24) exceeding a value of the force feedback.

Example 11: The marine maneuvering system (5) of any of examples 1-10, wherein upon the proximity signals indicating a plurality of targets (104-1, 104-2, 104-3, 104-4, 104-5) in the environment (102) towards at least a direction indicated by the direction value, the marine vessel control unit (30) being configured to: determine a distance between the marine vessel (100) and each one of the plurality of targets (104-1, 104-2, 104-3, 104-4, 104-5); and control the force feedback device (22) to apply a force feedback to the joystick (24) based on each one of the determined distances.

Example 12: The marine maneuvering system (5) of any of examples 1-11, the joystick (24) being movable in three degrees of freedom, wherein the force feedback device (22) comprises a respective force feedback unit for each degree of freedom of the joystick (24), wherein the marine vessel control unit (30) is configured to control the application of the force feedback to the joystick (24) through one or more of the force feedback units.

Example 13: The marine maneuvering system (5) of any of examples 1-12, wherein the marine vessel control unit (30) is further configured to control the force feedback device (30) based on navigable water conditions where the marine vessel (100) is traveling, the navigable water conditions including one or more of wind speed, wave height, current strength, and weather condition.

Example 14: The marine maneuvering system (5) of any of examples 1-13, wherein the marine vessel control unit (30) is further configured to: process the one or more proximity signals for determining at least one classification of the at least one target (104); and control the force feedback device (22) to apply a force feedback to the joystick (24) based on the determined at least one classification.

Example 15: The marine maneuvering system (5) of example 14, wherein the at least one classification comprises one of a mobility attribute, a size attribute, a mass attribute, a living attribute, or a material composition attribute.

Example 16: The marine maneuvering system (5) of any of examples 14-15, wherein the marine vessel control unit (30) is further configured to: calculate a weighted value of a plurality of classifications from among the at least one classification; and control the force feedback device (22) to apply a force feedback to the joystick based on the calculated weighted value.

Example 17: The marine maneuvering system (5) of any of examples 1-16, wherein the proximity sensor (10) is one of a lidar device, a radar device, a sonar device, an ultrasonic device, or a camera.

Example 18: The marine maneuvering system (5) of any of examples 1-17, wherein the requested movement of the joystick (24) is received in response to one of a manually or automatically initiated movement of the joystick (24).

Example 19: The marine maneuvering system (5) of any of examples 1-18, wherein the force feedback device (22) comprises an electrical brushed DC motor.

Example 20: The marine maneuvering system (5) of any of examples 1-19, wherein the marine vessel control unit (30) is further configured to cause control of the force feedback device (22) to apply a lingering force feedback application adapted to follow the movement of the marine vessel (20) in relation to the at least one target (104).

Example 21: A marine vessel (100) comprising the marine maneuvering system (5) according to any of examples 1-20.

Example 22: The marine vessel (100) of example 21, further comprising: a helm station (40); an auxiliary sensor unit (118; 119) being one of an inertial measurement unit (118) or a positioning sensor (119); and a propulsion system (110).

Example 23: The marine vessel (100) of example 22, wherein the propulsion system (110) comprises a pair of engines (112-1, 112-2), a pair of gears (114-1, 114-2), and a pair of rudders (116-1, 116-2).

Example 24: A computer-implemented method (200) for a marine vessel (100), comprising: obtaining (210) a requested movement of a joystick (24), the requested movement indicating a speed value and a direction value for an upcoming navigation of a marine vessel (100); obtaining (220) one or more proximity signals from a proximity sensor (10) in response to at least one target (104) being sensed in the environment (102) at least towards a direction indicated by the direction value; determining (230) a distance between the marine vessel (100) and the at least one target (104) based on the one or more proximity signals; and controlling (240) a force feedback device (22) to apply a force feedback to the joystick (24) based on the determined distance.

Example 25: The method (200) of example 24, wherein the controlling (240) further comprises: calculating (242) a maximum allowed speed for the marine vessel (100) based on the determined distance; translating (244) the maximum allowed speed into a maximum allowed joystick movement; and limiting (246) the requested movement of the joystick (24) based on the maximum allowed joystick movement.

Example 26: The method (200) of example 25, wherein the limiting (246) further comprises controlling (248) the force feedback device (22) to apply a force feedback value that counteracts a force of the requested movement.

Example 27: A computer program product comprising program code for performing, when executed by processing circuitry (602), the method of example 24.

Example 28: A non-transitory computer-readable storage medium comprising instructions, which when executed by processing circuitry (602), cause the processing circuitry (602) to perform the method of example 24.

The terminology used herein is for the purpose of describing particular aspects only and is not intended to be limiting of the disclosure. As used herein, the singular forms "a," "an," and "the" are intended to include the plural forms as well, unless the context clearly indicates otherwise. As used herein, the term "and/or" includes any and all combinations of one or more of the associated listed items. It will be further understood that the terms "comprises," "comprising," "includes," and/or "including" when used herein specify the presence of stated features, integers, actions, steps, operations, elements, and/or components, but do not preclude the presence or addition of one or more other features, integers, actions, steps, operations, elements, components, and/or groups thereof.

It will be understood that, although the terms first, second, etc., may be used herein to describe various elements, these elements should not be limited by these terms. These terms are only used to distinguish one element from another. For example, a first element could be termed a second element, and, similarly, a second element could be termed a first element without departing from the scope of the present disclosure.

Relative terms such as "below" or "above" or "upper" or "lower" or "horizontal" or "vertical" may be used herein to describe a relationship of one element to another element as illustrated in the Figures. It will be understood that these terms and those discussed above are intended to encompass different orientations of the device in addition to the orientation depicted in the Figures. It will be understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this disclosure belongs. It will be further understood that terms used herein should be interpreted as having a meaning consistent with their meaning in the context of this specification and the relevant art and will not be interpreted in an idealized or overly formal sense unless expressly so defined herein.

It is to be understood that the present disclosure is not limited to the aspects described above and illustrated in the drawings; rather, the skilled person will recognize that many changes and modifications may be made within the scope of the present disclosure and appended claims. In the drawings and specification, there have been disclosed aspects for purposes of illustration only and not for purposes of limitation, the scope of the disclosure being set forth in the following claims.

What is claimed is:

1. A marine maneuvering system for a marine vessel, comprising:

a proximity sensor configured to sense at least portions of an environment surrounding the marine vessel;

an input device adapted to provide navigational commands to the marine vessel, wherein the input device comprises a movable joystick and a force feedback device being adapted to apply a force feedback to the joystick; and a marine vessel control unit operatively connected to the proximity sensor and the input device, the marine vessel control unit being configured to:

obtain a requested movement of the joystick, the requested movement indicating a speed value and a direction value for an upcoming navigation of the marine vessel;

obtain one or more proximity signals from the proximity sensor in response to at least one target being sensed in the environment at least towards a direction indicated by the direction value;

determine a distance between the marine vessel and the at least one target based on the one or more proximity signals; and control the force feedback device to apply a force feedback to the joystick based on the determined distance by:

calculating a maximum allowed speed for the marine vessel based on the determined distance;

translating the maximum allowed speed into a maximum allowed joystick movement; and limiting the requested movement of the joystick based on the maximum allowed joystick movement.

2. The marine maneuvering system of claim 1, wherein the marine vessel control unit is further configured to limit the requested movement of the joystick by controlling the force feedback device to apply a force feedback value that counteracts a force of the requested movement.

3. The marine maneuvering system of claim 1, wherein the maximum allowed speed is further based on one or more operating conditions of the marine vessel.

4. The marine maneuvering system of claim 1, wherein the maximum allowed speed is further based on one or more ambient conditions of the environment in which the marine vessel is traveling.

5. The marine maneuvering system of claim 1, wherein the marine vessel control unit is further configured to control the force feedback device to gradually increase the applied force feedback when the distance between the marine vessel and the target is decreasing.

6. The marine maneuvering system of claim 1, wherein the marine vessel control unit is further configured to control the force feedback device to gradually increase the applied force feedback when the speed value is increasing.

7. The marine maneuvering system of claim 1, wherein the applied force feedback is overridable by an applied external force to the joystick exceeding a value of the force feedback.

8. The marine maneuvering system of claim 1, wherein upon the proximity signals indicating a plurality of targets in the environment towards at least a direction indicated by the direction value, the marine vessel control unit being configured to:

determine a distance between the marine vessel and each one of the plurality of targets; and control the force feedback device to apply a force feedback to the joystick based on each one of the determined distances.

9. The marine maneuvering system of claim 1, the joystick being movable in three degrees of freedom, wherein the force feedback device comprises a respective force feedback unit for each degree of freedom of the joystick, wherein the marine vessel control unit is configured to control the application of the force feedback to the joystick through one or more of the force feedback units.

10. The marine maneuvering system of claim 1, wherein the marine vessel control unit is further configured to control the force feedback device based on navigable water conditions where the marine vessel is traveling, the navigable water conditions including one or more of wind speed, wave height, current strength, and weather condition.

11. The marine maneuvering system of claim 1, wherein the marine vessel control unit is further configured to:

process the one or more proximity signals for determining at least one classification of the at least one target; and control the force feedback device to apply a force feedback to the joystick based on the determined at least one classification.

12. The marine maneuvering system of claim 11, wherein the at least one classification comprises one of a mobility attribute, a size attribute, a mass attribute, a living attribute, or a material composition attribute.

13. The marine maneuvering system of claim 11, wherein the marine vessel control unit is further configured to: calculate a weighted value of a plurality of classifications from among the at least one classification; and control the force feedback device to apply a force feedback to the joystick based on the calculated weighted value.

14. The marine maneuvering system of claim 1, wherein the requested movement of the joystick is received in response to one of a manually or automatically initiated movement of the joystick.

15. The marine maneuvering system of claim 1, wherein the marine vessel control unit is further configured to control the force feedback device to apply a fixed or variable force feedback value.

16. A marine vessel comprising the marine maneuvering system of claim 1.

17. A computer-implemented method for a marine vessel, comprising:

obtaining a requested movement of a joystick, the requested movement indicating a speed value and a direction value for an upcoming navigation of a marine vessel;

obtaining one or more proximity signals from a proximity sensor in response to at least one target being sensed in the environment at least towards a direction indicated by the direction value;

determining a distance between the marine vessel and the at least one target based on the one or more proximity signals; and controlling a force feedback device to apply a force feedback to the joystick based on the determined distance by:

calculating a maximum allowed speed for the marine vessel based on the determined distance;

translating the maximum allowed speed into a maximum allowed joystick movement; and limiting the requested movement of the joystick based on the maximum allowed joystick movement.

18. A non-transitory computer-readable storage medium comprising instructions, which when executed by processing circuitry, cause the processing circuitry to perform the method of claim 17.

* * * * *